US008767005B2

(12) United States Patent
Holland et al.

(10) Patent No.: US 8,767,005 B2
(45) Date of Patent: Jul. 1, 2014

(54) BLEND EQUATION

(75) Inventors: Peter F. Holland, Sunnyvale, CA (US); Vaughn T. Arnold, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 617 days.

(21) Appl. No.: 13/026,554

(22) Filed: Feb. 14, 2011

(65) Prior Publication Data

US 2012/0206474 A1 Aug. 16, 2012

(51) Int. Cl.
*G09G 5/02* (2006.01)

(52) U.S. Cl.
USPC ..... 345/592; 345/581; 345/589; 345/606; 345/611; 345/614; 345/629; 345/506; 382/260

(58) Field of Classification Search
CPC ..... G09G 5/02; G09G 2320/0666; G09G 2340/10; G06T 15/503; G06T 3/4007
See application file for complete search history.

(56) References Cited

U.S. PATENT DOCUMENTS 6,239,815 B1 * 5/2001 Frink et al. ..... 345/502
7,167,184 B2 * 1/2007 Graham ..... 345/592
7,330,192 B2 2/2008 Brunner et al.
2001/0052906 A1 12/2001 Chen
2003/0184553 A1 * 10/2003 Dawson ..... 345/581
2010/0066755 A1 3/2010 Louveaux

* cited by examiner

*Primary Examiner* — Antonio A Caschera
(74) *Attorney, Agent, or Firm* — Lawrence J. Merkel; Meyertons, Hood, Kivlin, Kowert & Goetzel P.C.

(57) ABSTRACT

A blend unit in a display pipe for processing pixels of video and/or image frames may include multiple blend stages, where each blend stage may include multiple levels for blending pixels according to a blend equation. The blending operation includes blending pixel color values and Alpha values. A multiplication may be performed at each blend level, necessitating Alpha value normalizations in the form of divisions to obtain pixel color values having a specified bit-length. Color value normalizations are not needed when the desired result is an actual color value. In order to reduce the compounding of errors that may result from the introduction of an error at each division, Alpha value normalizations may not be performed at each blend level, carrying the intermediate results forward in fractional form—through one or multiple blend stages—until the end of the blending operation. At or after the final blend level—in each blend stage, or in a final blend stage—a single division may performed, preventing the compounding of errors that would be incurred at each blend level if a division at each blend level were performed.

23 Claims, 7 Drawing Sheets

| Blend Mode | Equation | Description |
|---|---|---|
| Disabled | Cout[k,i] = Cout[k-1,i] | No layer k blending. Layer k is not used. |
| Normal | Cout[k,i] = C[k,i] * ADis[k] * A[k,i] + Cout[k -1,i] * ( 1 – ADis[k] * A[k,i] ) | Per-pixel Alpha blending with dissolve |
| Premultiplied | Cout[k,i] = C[k,i] * ADis[k] + Cout[k-1,i] * ( 1 – ADis[k] * A[k,i] ) | Per-pixel premultiplied Alpha blending with dissolve |
| Saturate | Cout[k,i] = C[k,i] * ADis[k] * ASat[k] + Cout[k-1,i] * ( 1 – ADis[k] * ASat[k] ) | Override per-pixel Alpha |

400

FIG. 4

| Blend Mode | Alpha for Current Layer AEffCur[i] | Alpha for Previous Layer AEffPrev[i] | Description |
|---|---|---|---|
| Disabled | No Alpha | No Alpha | No layer k blending. Layer k is not used. |
| Normal | ADis[k] * A[k,i] | ADis[k] * A[k,i] | Per-pixel Alpha blending with dissolve |
| Premultiplied | ADis[k] | ADis[k] * A[k,i] | Per-pixel premultiplied Alpha blending with dissolve |
| Saturate | ADis[k] * ASat[k] | ADis[k] * ASat[k] | Override per-pixel Alpha |

500

FIG. 5

BLEND EQUATION

BACKGROUND

1. Field of the Invention

This invention is related to the field of graphical information processing, more particularly, to blending multiple layers of pixels.

2. Description of the Related Art

Part of the operation of many computer systems, including portable digital devices such as mobile phones, notebook computers and the like is the use of some type of display device, such as a liquid crystal display (LCD), to display images, video information/streams, and data. Accordingly, these systems typically incorporate functionality for generating images and data, including video information, which are subsequently output to the display device. Such devices typically include video graphics circuitry to process images and video information for subsequent display.

In digital imaging, the smallest item of information in an image is called a "picture element", more generally referred to as a "pixel". For convenience, pixels are generally arranged in a regular two-dimensional grid. By using this arrangement, many common operations can be implemented by uniformly applying the same operation to each pixel independently. Since each pixel is an elemental part of a digital image, a greater number of pixels can provide a more accurate representation of the digital image. The intensity of each pixel can vary, and in color systems each pixel has typically three or four components such as red, green, blue, and black.

Most images and video information displayed on display devices such as LCD screens are interpreted as a succession of image frames, or frames for short. While generally a frame is one of the many still images that make up a complete moving picture or video stream, a frame can also be interpreted more broadly as simply a still image displayed on a digital (discrete, or progressive scan) display. A frame typically consists of a specified number of pixels according to the resolution of the image/video frame. Information associated with a frame typically consists of color values for every pixel to be displayed on the screen. Color values are commonly stored in 1-bit monochrome, 4-bit palletized, 8-bit palletized, 16-bit high color and 24-bit true color formats. An additional alpha channel is oftentimes used to retain information about pixel transparency. The color values can represent information corresponding to any one of a number of color spaces.

In addition to the color values, the pixels may also have associated per-pixel Alpha values providing opacity information for the pixel. Alpha values may be stored what is commonly referred to as an Alpha channel, and each Alpha value may be between 0 and 1, with a value of 0 meaning that the pixel does not have any coverage information and is transparent, and a value of 1 meaning that the pixel is opaque. Based on this opacity information, various layers of an image frame may be blended together. In general, blending is the process of combining multiple layers of an image to overlay portion of one layer atop another layer, or to create the appearance of partial transparency of certain elements in some of the layers. For example, blending is used extensively when combining computer rendered image elements with live footage. In many cases blending operations include multiple layers that perform blending, where each level performs a normalization division. Over multiple levels of blending, the errors introduced by the normalization at each level may be compounded, resulting in less than the desired accuracy in how the blended images are displayed.

Other corresponding issues related to the prior art will become apparent to one skilled in the art after comparing such prior art with the present invention as described herein.

SUMMARY

A blend unit in a display pipe for processing pixels of video and/or image frames may include multiple blend stages for blending pixels for multiple layers. For example, multiple (two, three, or more) layers may be blended two layers at a time, each blend stage performing a blend operation on two layers, with the output of any given blend stage providing the input to the next blend stage, through to a final blend stage. A blend equation used for blending within each blend stage may be a multi-step equation that involves multiple blend levels. Within each given blend stage, the Alpha values and color values of the current layer, and the color results representative of a previously blended layer (beginning with a background layer) may all be combined to obtain an output value for a given pixel position in the combined layers. Blending may be performed using multiple types of Alpha values. For example, individual pixels may each have a corresponding per-pixel Alpha value, individual frames may each have a static per-frame Alpha value, and individual frames may each have a static per-frame combining Alpha value, otherwise referred to as a per-frame dissolve Alpha value. In some embodiments, the per-pixel Alpha value may be pre-multiplied with the color value.

Blending may be performed according to one of multiple blend modes, each blend mode specifying which types of Alpha values are used in the blend process. In a first blend mode, per-pixel Alpha values may be combined with the per-frame dissolve Alpha value to obtain an effective Alpha value. In a second blend mode, per-pixel premultiplied Alpha values may be combined with the per-frame dissolve Alpha value to obtain the effective Alpha value. In a third blend mode, per-pixel Alpha values may be overridden by a per-frame static Alpha value to obtain the effective Alpha value. The Alpha values (each type of Alpha value) may be represented as N-bit indices, corresponding to decimal Alpha values in the range of 0 to 1. Color values may each be represented as indices of a specified bit-length, and may be represented for each color plane or color component of the color space for each given pixel. The blend equation may include one or more terms that contain multiplication by an N-bit Alpha value. Since the result of the multiplication of a color value by an N-bit Alpha value yields a color value having a bit-size augmented by N bits, the result may need to be normalized to obtain a color value of appropriate bit-length. In other words, for the blend operation to produce output color values properly represented as indices of the specified bit-length, terms that contain multiplication by an N-bit Alpha value may need to be normalized by dividing each such term by $2^N-1$.

However, when performing the above divisions, an error may occur in the calculations, as the performed division(s) may be restricted to a fixed point, thereby dropping fractional portions of the results. When blending multiple levels, that is, when multiple terms in the blend equation contain a multiplication, performing normalization for each blend level (or each term) separately, such inaccuracies may add up, resulting in substantial errors in the final blend output. In addition, these errors may be further compounded over multiple blend stages. However, color value normalizations may not be required when the desired result is itself an actual color value. Therefore, errors in the calculation may be reduced if the Alpha value normalizations are not be performed at each blend level (i.e. for each term that contains a multiplication), and the results are carried forward in fractional form for as long as it is possible throughout the blend process. In one set of embodiments, partial results within a blend stage may be carried in fractional form until the very end of the blend stage, and a single division may be performed at the output of the blend stage. This may prevent the compounding of errors that may be incurred at each blend level if a division were performed at each blend level. While theoretically the partial results, or the intermediate blend results of each blend stage, may be carried in fractional form through the entire blending process, the denominator of the final division may increase to impractical bit-lengths. Consequently, the extent to which the fractional terms are carried through the blending process may be determined by various design considerations, including processing power, register width, bus width, etc.

BRIEF DESCRIPTION OF THE DRAWINGS

The following detailed description makes reference to the accompanying drawings, which are now briefly described.

FIG. 4 shows a table of the blend equations for different possible blending modes, according to one embodiment.

FIG. 5 shows a table of the respective calculations of effective Alpha values for different possible blending modes, according to one embodiment.

Figure 1:
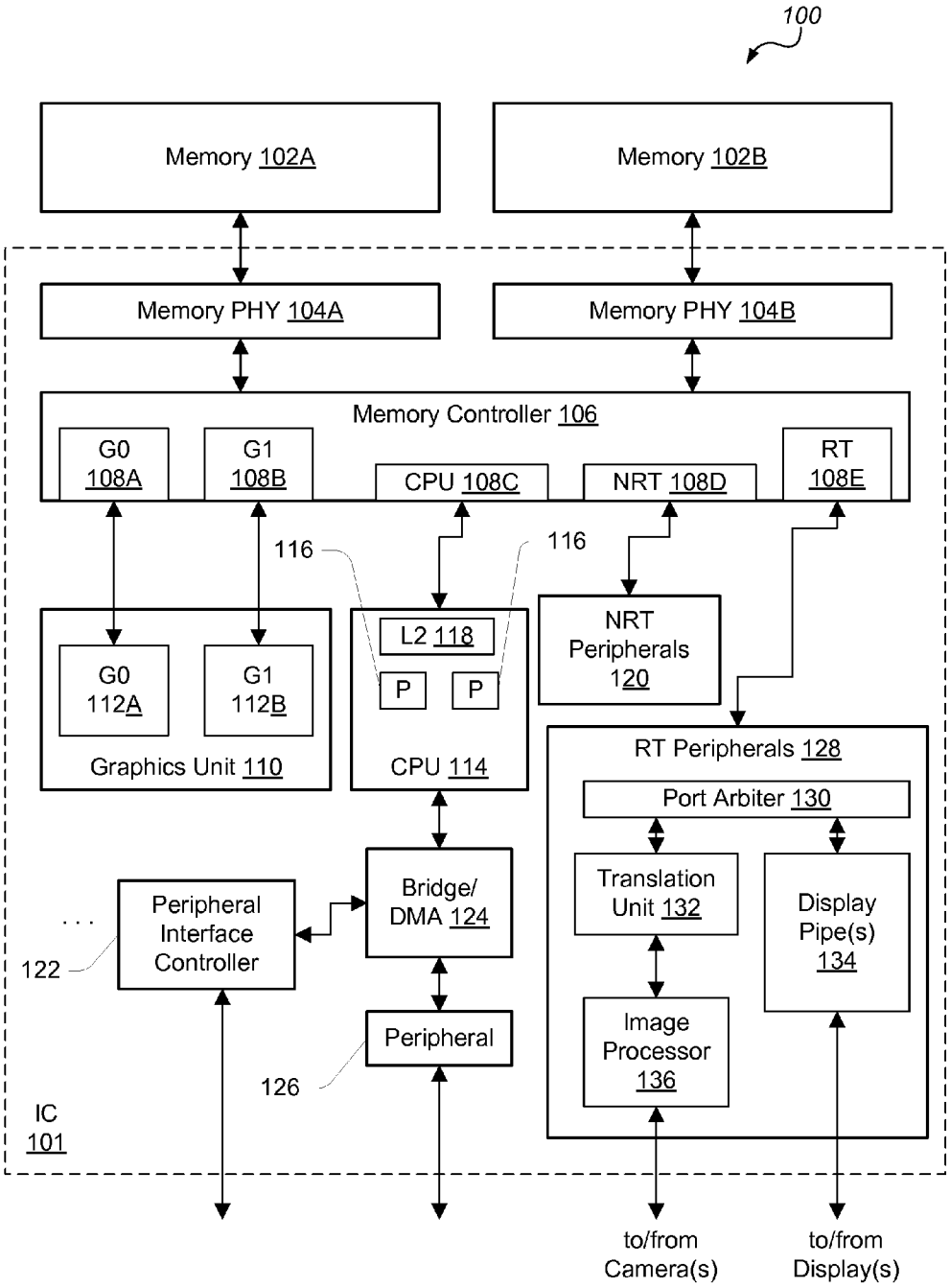
FIG. 1 is a block diagram of one embodiment of an integrated circuit that include a graphics display system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits and/or memory storing program instructions executable to implement the operation. The memory can include volatile memory such as static or dynamic random access memory and/or nonvolatile memory such as optical or magnetic disk storage, flash memory, programmable read-only memories, etc. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. §112, paragraph six interpretation for that unit/circuit/component.

DETAILED DESCRIPTION OF EMBODIMENTS

Turning now to FIG. 1, a block diagram of one embodiment of a system 100 is shown. In the embodiment of FIG. 1, system 100 includes an integrated circuit (IC) 101 coupled to external memories 102A-102B. In the illustrated embodiment, IC 101 includes a central processor unit (CPU) block 114, which includes one or more processors 116 and a level 2 (L2) cache 118. Other embodiments may not include L2 cache 118 and/or may include additional levels of cache. Additionally, embodiments that include more than two processors 116 and that include only one processor 116 are contemplated. IC 101 further includes a set of one or more non-real time (NRT) peripherals 120 and a set of one or more real time (RT) peripherals 128. In the illustrated embodiment, RT peripherals 128 include an image processor 136, one or more display pipes 134, a translation unit 132, and a port arbiter 130. Other embodiments may include more processors 136 or fewer image processors 136, more display pipes 134 or fewer display pipes 134, and/or any additional real time peripherals as desired. Image processor 136 may be coupled to receive image data from one or more cameras in system 100. Similarly, display pipes 134 may be coupled to one or more display controllers (not shown) which may control one or more displays in the system. Image processor 136 may be coupled to translation unit 132, which may be further coupled to port arbiter 130, which may be coupled to display pipes 134 as well. In the illustrated embodiment, CPU block 114 is coupled to a bridge/direct memory access (DMA) controller 124, which may be coupled to one or more peripheral devices 126 and/or to one or more peripheral interface controllers 122. The number of peripheral devices 126 and peripheral interface controllers 122 may vary from zero to any desired number in various embodiments. System 100 illustrated in FIG. 1 further includes a graphics unit 110 comprising one or more graphics controllers such as G0 112A and G1 112B. The number of graphics controllers per graphics unit and the number of graphics units may vary in other embodiments. As illustrated in FIG. 1, system 100 includes a memory controller 106 coupled to one or more memory physical interface circuits (PHYs) 104A-104B. The memory PHYs 104A-104B are configured to communicate with memories 102A-102B via pins of IC 101. Memory controller 106 also includes a set of ports 108A-108E. Ports 108A-108B are coupled to graphics controllers 112A-112B, respectively. CPU block 114 is coupled to port 108C. NRT peripherals 120 and RT peripherals 128 are coupled to ports 108D-108E, respectively. The number of ports included in memory controller 106 may be varied in other embodiments, as may the number of memory controllers. In other embodiments, the number of memory physical layers (PHYs) 104A-104B and corresponding memories 102A-102B may be less or more than the two instances shown in FIG. 1.

In one embodiment, each port 108A-108E may be associated with a particular type of traffic. For example, in one embodiment, the traffic types may include RT traffic, Non-RT (NRT) traffic, and graphics traffic. Other embodiments may include other traffic types in addition to, instead of, or in addition to a subset of the above traffic types. Each type of traffic may be characterized differently (e.g. in terms of requirements and behavior), and memory controller 106 may handle the traffic types differently to provide higher performance based on the characteristics. For example, RT traffic requires servicing of each memory operation within a specific amount of time. If the latency of the operation exceeds the specific amount of time, erroneous operation may occur in RT peripherals 128. For example, image data may be lost in image processor 136 or the displayed image on the displays to which display pipes 134 are coupled may visually distort. RT traffic may be characterized as isochronous, for example. On the other hand, graphics traffic may be relatively high bandwidth, but not latency-sensitive. NRT traffic, such as from processors 116, is more latency-sensitive for performance reasons but survives higher latency. That is, NRT traffic may generally be serviced at any latency without causing erroneous operation in the devices generating the NRT traffic. Similarly, the less latency-sensitive but higher bandwidth graphics traffic may be generally serviced at any latency. Other NRT traffic may include audio traffic, which is relatively low bandwidth and generally may be serviced with reasonable latency. Most peripheral traffic may also be NRT (e.g. traffic to storage devices such as magnetic, optical, or solid state storage). By providing ports 108A-108E associated with different traffic types, memory controller 106 may be exposed to the different traffic types in parallel.

As mentioned above, RT peripherals 128 may include image processor 136 and display pipes 134. Display pipes 134 may include circuitry to fetch one or more image frames and to blend the frames to create a display image. Display pipes 134 may further include one or more video pipelines, and video frames may be blended with (relatively) static image frames to create frames for display at the video frame rate. The output of display pipes 134 may be a stream of pixels to be displayed on a display screen. The pixel values may be transmitted to a display controller for display on the display screen. Image processor 136 may receive camera data and process the data to an image to be stored in memory.

Both the display pipes 134 and image processor 136 may operate in virtual address space, and thus may use translations to generate physical addresses for the memory operations to read or write memory. Image processor 136 may have a somewhat random-access memory pattern, and may thus rely on translation unit 132 for translation. Translation unit 132 may employ a translation look-aside buffer (TLB) that caches each translation for a period of time based on how frequently the translation is used with respect to other cached translations. For example, the TLB may employ a set associative or fully associative construction, and a least recently used (LRU)-type algorithm may be used to rank recency of use of the translations among the translations in a set (or across the TLB in fully associative configurations). LRU-type algorithms may include, for example, true LRU, pseudo-LRU, most recently used (MRU), etc. Additionally, a fairly large TLB may be implemented to reduce the effects of capacity misses in the TLB.

The access patterns of display pipes 134, on the other hand, may be fairly regular. For example, image data for each source image may be stored in consecutive memory locations in the virtual address space. Thus, display pipes 134 may begin processing source image data from a virtual page, and subsequent virtual pages may be consecutive to the virtual page. That is, the virtual page numbers may be in numerical order, increasing or decreasing by one from page to page as the image data is fetched. Similarly, the translations may be consecutive to one another in a given page table in memory (e.g. consecutive entries in the page table may translate virtual page numbers that are numerically one greater than or less than each other). While more than one page table may be used in some embodiments, and thus the last entry of the page table may not be consecutive to the first entry of the next page table, most translations may be consecutive in the page tables. Viewed in another way, the virtual pages storing the image data may be adjacent to each other in the virtual address space. That is, there may be no intervening pages between the adjacent virtual pages in the virtual address space.

Display pipes 134 may implement translation units that prefetch translations in advance of the display pipes' reads of image data. The prefetch may be initiated when the processing of a source image is to start, and the translation unit may prefetch enough consecutive translations to fill a translation memory in the translation unit. The fetch circuitry in the display pipes may inform the translation unit as the processing of data in virtual pages is completed, and the translation unit may invalidate the corresponding translation, and prefetch additional translations. Accordingly, once the initial prefetching is complete, the translation for each virtual page may frequently be available in the translation unit as display pipes 134 begin fetching from that virtual page. Additionally, competition for translation unit 132 from display pipes 134 may be eliminated in favor of the prefetching translation units. Since translation units 132 in display pipes 134 fetch translations for a set of contiguous virtual pages, they may be referred to as "streaming translation units."

In general, display pipes 134 may include one or more user interface units that are configured to fetch relatively static frames. That is, the source image in a static frame is not part of a video sequence. While the static frame may be changed, it is not changing according to a video frame rate corresponding to a video sequence. Display pipes 134 may further include one or more video pipelines configured to fetch video frames. These various pipelines (e.g. the user interface units and video pipelines) may be generally referred to as "image processing pipelines."

Returning to the memory controller 106, generally a port may be a communication point on memory controller 106 to communicate with one or more sources. In some cases, the port may be dedicated to a source (e.g. ports 108A-108B may be dedicated to the graphics controllers 112A-112B, respectively). In other cases, the port may be shared among multiple sources (e.g. processors 116 may share CPU port 108C, NRT peripherals 120 may share NRT port 108D, and RT peripherals 128 such as display pipes 134 and image processor 136 may share RT port 108E. A port may be coupled to a single interface to communicate with the one or more sources. Thus, when sources share an interface, there may be an arbiter on the sources' side of the interface to select between the sources. For example, L2 cache 118 may serve as an arbiter for CPU port 108C to memory controller 106. Port arbiter 130 may serve as an arbiter for RT port 108E, and a similar port arbiter (not shown) may be an arbiter for NRT port 108D. The single source on a port or the combination of sources on a port may be referred to as an agent. Each port 108A-108E is coupled to an interface to communicate with its respective agent. The interface may be any type of communication medium (e.g. a bus, a point-to-point interconnect, etc.) and may implement any protocol. In some embodiments, ports 108A-108E may all implement the same interface and protocol. In other embodiments, different ports may implement different interfaces and/or protocols. In still other embodiments, memory controller 106 may be single ported.

In an embodiment, each source may assign a quality of service (QoS) parameter to each memory operation transmitted by that source. The QoS parameter may identify a requested level of service for the memory operation. Memory operations with QoS parameter values requesting higher levels of service may be given preference over memory operations requesting lower levels of service. Each memory operation may include a flow ID (FID). The FID may identify a memory operation as being part of a flow of memory operations. A flow of memory operations may generally be related, whereas memory operations from different flows, even if from the same source, may not be related. A portion of the FID (e.g. a source field) may identify the source, and the remainder of the FID may identify the flow (e.g. a flow field). Thus, an FID may be similar to a transaction ID, and some sources may simply transmit a transaction ID as an FID. In such a case, the source field of the transaction ID may be the source field of the FID and the sequence number (that identifies the transaction among transactions from the same source) of the transaction ID may be the flow field of the FID. In some embodiments, different traffic types may have different definitions of QoS parameters. That is, the different traffic types may have different sets of QoS parameters.

Memory controller 106 may be configured to process the QoS parameters received on each port 108A-108E and may use the relative QoS parameter values to schedule memory operations received on the ports with respect to other memory operations from that port and with respect to other memory operations received on other ports. More specifically, memory controller 106 may be configured to compare QoS parameters that are drawn from different sets of QoS parameters (e.g. RT QoS parameters and NRT QoS parameters) and may be configured to make scheduling decisions based on the QoS parameters.

In some embodiments, memory controller 106 may be configured to upgrade QoS levels for pending memory operations. Various upgrade mechanism may be supported. For example, the memory controller 106 may be configured to upgrade the QoS level for pending memory operations of a flow responsive to receiving another memory operation from the same flow that has a QoS parameter specifying a higher QoS level. This form of QoS upgrade may be referred to as in-band upgrade, since the QoS parameters transmitted using the normal memory operation transmission method also serve as an implicit upgrade request for memory operations in the same flow. The memory controller 106 may be configured to push pending memory operations from the same port or source, but not the same flow, as a newly received memory operation specifying a higher QoS level. As another example, memory controller 106 may be configured to couple to a sideband interface from one or more agents, and may upgrade QoS levels responsive to receiving an upgrade request on the sideband interface. In another example, memory controller 106 may be configured to track the relative age of the pending memory operations. Memory controller 106 may be configured to upgrade the QoS level of aged memory operations at certain ages. The ages at which upgrade occurs may depend on the current QoS parameter of the aged memory operation.

Memory controller 106 may be configured to determine the memory channel addressed by each memory operation received on the ports, and may be configured to transmit the memory operations to memory 102A-102B on the corresponding channel. The number of channels and the mapping of addresses to channels may vary in various embodiments and may be programmable in the memory controller. Memory controller 106 may use the QoS parameters of the memory operations mapped to the same channel to determine an order of memory operations transmitted into the channel.

Processors 116 may implement any instruction set architecture, and may be configured to execute instructions defined in that instruction set architecture. For example, processors 116 may employ any microarchitecture, including but not limited to scalar, superscalar, pipelined, superpipelined, out of order, in order, speculative, non-speculative, etc., or combinations thereof. Processors 116 may include circuitry, and optionally may implement microcoding techniques, and may include one or more level 1 caches, making cache 118 an L2 cache. Other embodiments may include multiple levels of caches in processors 116, and cache 118 may be the next level down in the hierarchy. Cache 118 may employ any size and any configuration (set associative, direct mapped, etc.).

Graphics controllers 112A-112B may be any graphics processing circuitry. Generally, graphics controllers 112A-112B may be configured to render objects to be displayed, into a frame buffer. Graphics controllers 112A-112B may include graphics processors that may execute graphics software to perform a part or all of the graphics operation, and/or hardware acceleration of certain graphics operations. The amount of hardware acceleration and software implementation may vary from embodiment to embodiment.

NRT peripherals 120 may include any non-real time peripherals that, for performance and/or bandwidth reasons, are provided independent access to memory 102A-102B. That is, access by NRT peripherals 120 is independent of CPU block 114, and may proceed in parallel with memory operations of CPU block 114. Other peripherals such as peripheral 126 and/or peripherals coupled to a peripheral interface controlled by peripheral interface controller 122 may also be non-real time peripherals, but may not require independent access to memory. Various embodiments of NRT peripherals 120 may include video encoders and decoders, scaler/rotator circuitry, image compression/decompression circuitry, etc.

Bridge/DMA controller 124 may comprise circuitry to bridge peripheral(s) 126 and peripheral interface controller(s) 122 to the memory space. In the illustrated embodiment, bridge/DMA controller 124 may bridge the memory operations from the peripherals/peripheral interface controllers through CPU block 114 to memory controller 106. CPU block 114 may also maintain coherence between the bridged memory operations and memory operations from processors 116/L2 Cache 118. L2 cache 118 may also arbitrate the bridged memory operations with memory operations from processors 116 to be transmitted on the CPU interface to CPU port 108C. Bridge/DMA controller 124 may also provide DMA operation on behalf of peripherals 126 and peripheral interface controllers 122 to transfer blocks of data to and from memory. More particularly, the DMA controller may be configured to perform transfers to and from memory 102A-102B through memory controller 106 on behalf of peripherals 126 and peripheral interface controllers 122. The DMA controller may be programmable by processors 116 to perform the DMA operations. For example, the DMA controller may be programmable via descriptors, which may be data structures stored in memory 102A-102B to describe DMA transfers (e.g. source and destination addresses, size, etc.). Alternatively, the DMA controller may be programmable via registers in the DMA controller (not shown).

Peripherals 126 may include any desired input/output devices or other hardware devices that are included on IC 101. For example, peripherals 126 may include networking peripherals such as one or more networking media access controllers (MAC) such as an Ethernet MAC or a wireless fidelity (WiFi) controller. An audio unit including various audio processing devices may be included in peripherals 126. Peripherals 126 may include one or more digital signal processors, and any other desired functional components such as timers, an on-chip secrets memory, an encryption engine, etc., or any combination thereof.

Peripheral interface controllers 122 may include any controllers for any type of peripheral interface. For example, peripheral interface controllers 122 may include various interface controllers such as a universal serial bus (USB) controller, a peripheral component interconnect express (PCIe) controller, a flash memory interface, general purpose input/output (I/O) pins, etc.

Memories 102A-102B may be any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., and/or low power versions of the SDRAMs such as LPDDR2, etc.), RAMBUS DRAM (RDRAM), static RAM (SRAM), etc. One or more memory devices may be coupled onto a circuit board to form memory modules such as single inline memory modules (SIMMs), dual inline memory modules (DIMM5), etc. Alternatively, the devices may be mounted with IC 101 in a chip-on-chip configuration, a package-on-package configuration, or a multi-chip module configuration.

Memory PHYs 104A-104B may handle the low-level physical interface to memory 102A-102B. For example, memory PHYs 104A-104B may be responsible for the timing of the signals, for proper clocking to synchronous DRAM memory, etc. In one embodiment, memory PHYs 104A-104B may be configured to lock to a clock supplied within IC 101 and may be configured to generate a clock used by memory 102A and/or memory 102B.

It is noted that other embodiments may include other combinations of components, including subsets or supersets of the components shown in FIG. 1 and/or other components. While one instance of a given component may be shown in FIG. 1, other embodiments may include one or more instances of the given component.

Figure 2:
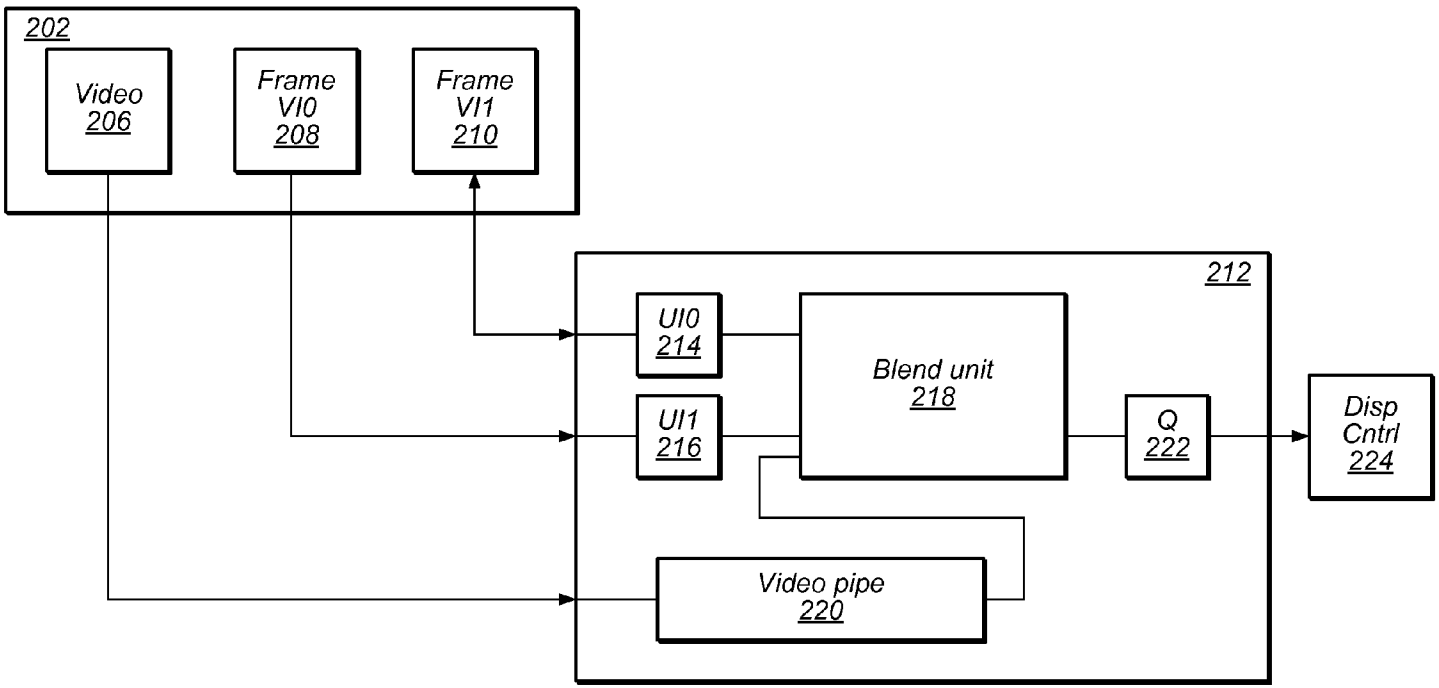
FIG. 2 is a block diagram of one embodiment of a graphics display system including system memory.

Turning now to FIG. 2, a partial block diagram is shown providing an overview of an exemplary system in which image frame information may be stored in memory 202, which may be system memory, and provided to a display pipe 212. As shown in FIG. 2, memory 202 may include a video buffer 206 for storing video frames/information, and one or more (in the embodiment shown, a total of two) image frame buffers 208 and 210 for storing image frame information. In some embodiments, the video frames/information stored in video buffer 206 may be represented in a first color space, according the origin of the video information. For example, the video information may be represented in the YCbCr color space. At the same time, the image frame information stored in image frame buffers 208 and 210 may be represented in a second color space, according to the preferred operating mode of display pipe 212. For example, the image frame information stored in image frame buffers 208 and 210 may be represented in the RGB color space. Display pipe 212 may include one or more user interface (UI) units, shown as UI 214 and 216 in the embodiment of FIG. 2, which may be coupled to memory 202 from where they may fetch the image frame data/information. A video pipe or processor 220 may be similarly configured to fetch the video data from memory 202, more specifically from video buffer 206, and perform various operations on the video data. UI 214 and 216, and video pipe 220 may respectively provide the fetched image frame information and video image information to a blend unit 218 to generate output frames that may be stored in a buffer 222, from which they may be provided to a display controller 224 for display on a display device (not shown), for example an LCD.

In one set of embodiments, UI 214 and 216 may include one or more registers programmable to define at least one active region per frame stored in buffers 208 and 210. Active regions may represent those regions within an image frame that contain pixels that are to be displayed, while pixels outside of the active region of the frame are not to be displayed. In order to reduce the number of accesses that may be required to fetch pixels from frame buffers 208 and 210, when fetching frames from memory 202 (more specifically from frame buffers 208 and 210), UI 214 and 216 may fetch only those pixels of any given frame that are within the active regions of the frame, as defined by the contents of the registers within UI 214 and 216. The pixels outside the active regions of the frame may be considered to have an alpha value corresponding to a blend value of zero. In other words, pixels outside the active regions of a frame may automatically be treated as being transparent, or having an opacity of zero, thus having no effect on the resulting display frame. Consequently, the fetched pixels may be blended with pixels from other frames, and/or from processed video frame or frames provided by video pipe 220 to blend unit 218.

Figure 3:
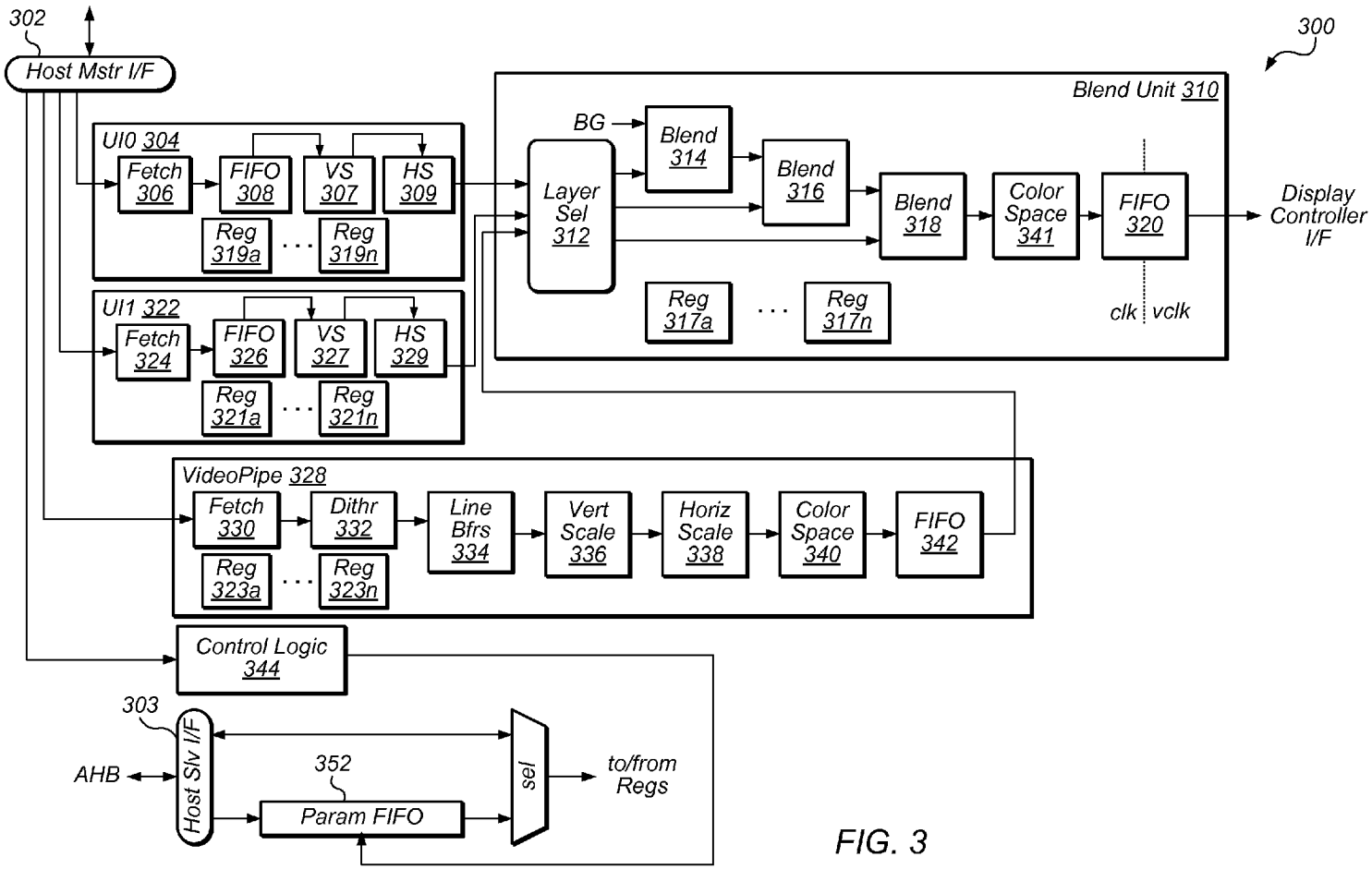
FIG. 3 is a block diagram of one embodiment of a display pipe in a graphics display system.

Turning now to FIG. 3, a more detailed logic diagram of one embodiment 300 of display pipe 212 is shown. In one set of embodiments, display pipe 300 may function to deliver graphics and video data residing in memory (or some addressable form of memory, e.g. memory 202 in FIG. 2) to a display controller or controllers that may support both LCD and analog/digital TV displays. The video data, which may be represented in one color space, likely the YCbCr color space, may be dithered, scaled, converted to another color space (for example the RGB color space) for use in blend unit 310, and blended with up to a specified number (e.g. 2) of graphics (user interface) planes that are also represented in the second (i.e. RGB) color space. Display pipe 300 may run in its own clock domain, and may provide an asynchronous interface to the display controllers to support displays of different sizes and timing requirements. Display pipe 300 may consist of one or more (in this case two) user interface (UI) blocks 304 and 322 (which may correspond to UI 214 and 216 of FIG. 2), a blend unit 310 (which may correspond to blend unit 218 of FIG. 2), a video pipe 328 (which may correspond to video pipe 220 of FIG. 2), a parameter FIFO 352, and Master and Slave Host Interfaces 302 and 303, respectively. The blocks shown in the embodiment of FIG. 3 may be modular, such that with some redesign, user interfaces and video pipes may be added or removed, or host master or slave interfaces 302 and 303 may be changed, for example.

Display pipe 300 may be designed to fetch data from memory, process that data, then presents it to an external display controller through an asynchronous FIFO 320. The display controller may control the timing of the display through a Vertical Blanking Interval (VBI) signal that may be activated at the beginning of each vertical blanking interval. This signal may cause display pipe 300 to initialize (Restart) and start (Go) the processing for a frame (more specifically, for the pixels within the frame). Between initializing and starting, configuration parameters unique to that frame may be modified. Any parameters not modified may retain their value from the previous frame. As the pixels are processed and put into output FIFO 320, the display controller may issue signals (referred to as pop signals) to remove the pixels at the display controller's clock frequency (indicated as vclk in FIG. 3).

In the embodiment shown in FIG. 3, each UI unit may include one or more registers 319*a*-319*n* and 321*a*-321*n*, respectively, to hold image frame information that may include active region information, base address information, and/or frame size information among others. Each UI unit may also include a respective fetch unit, 306 and 324, respectively, which may operate to fetch the frame information, or more specifically the pixels contained in a given frame from memory, through host master interface 302. As previously mentioned, the pixel values may be represented in the color space designated as the operating color space of the blend unit, in this case the RGB color space, but which may be any designated color space in alternate embodiments. In one set of embodiments, fetch units 306 and 324 may only fetch those pixels of any given frame that are within the active region of the given frame, as defined by the contents of registers 319*a*-319*n* and 321*a*-321*n*. The fetched pixels may be fed to respective FIFO buffers 308 and 326, from which the UI units may provide the fetched pixels to blend unit 310, more specifically to a layer select unit 312 within blend unit 310. Blend unit 310 may then blend the fetched pixels obtained from UI 304 and 322 with pixels from other frames and/or video pixels obtained from video pipe 328. The pixels may be blended in blend stages 314, 316, and 318 to produce an output frame or output frames, which may then be passed to FIFO 320 to be retrieved by a display controller interface coupling to FIFO 320, to be displayed on a display of choice, for example an LCD. In one set of embodiments, the output frame(s) may be converted back to the original color space of the video information, e.g. to the YCbCr color space, to be displayed on the display of choice, The overall operation of blend unit 310 will now be described. Blend unit 310 may be situated at the backend of display pipe 300 as shown in FIG. 3. It may receive frames of pixels from UI 304 and 322, and from video pipe 328 through layer select unit 312, and may blend them together layer by layer. In one set of embodiments, the pixels received by blend unit 310 may be represented in a first color space (e.g. RGB), in which blend unit 310 may operate. The frames fetched by UI 304 and UI 322 through host interface 302 may already be represented in the first color space. However, the video image frame information fetched by fetch unit 330 within video pipe 328 may be represented in a second color space (e.g. YCbCr). Thus, the video image frame pixels fetched by video pipe 328 may first be converted to the first color space (in which blend unit 310 may operate) via color space converter 340, and the converted video image frame pixels—now also represented in the first color space—may then be provided to blend unit 310 for blending. After the blend operation has been completed, the component color values may undergo a final conversion of a 3×3 matrix multiplication and a positive/negative offset. The final resultant pixels may be converted to the second color space (e.g. to YCbCr) through color space converter unit 341, queued up in output FIFO 320 at the video pipe's clock rate of clk, and fetched by a display controller at the display controller's clock rate of vclk. It should be noted that while FIFO 320 is shown inside blend unit 310, alternative embodiments may position FIFO 320 outside blend unit 310 and possibly within a display controller unit. In addition, while color space conversion by converter unit 341 is shown to take place prior to providing the resultant pixels to FIFO 320, in alternate embodiments the color conversion may be performed on the data fetched from FIFO 320.

The sources to blend unit 310 (UI 304 and 326, and/or video pipe 328) may provide the pixel data and per-pixel Alpha values for an entire frame with width, display width, and height, display height, in pixels starting at a specified default pixel location, (e.g. 0,0). Blend unit 310 may functionally operate on a single layer at a time. The lowest layer may be defined as the background color (BG, provided to blend stage 314). Layer 1 may blend with layer 0 (at blend stage 316). The next layer, layer 2, may blend with the output from blend stage 316 (at blend stage 318), and so on until all the layers are blended. For the sake of simplicity, only three blend stages 314-318 are shown, but display pipe 300 may include more or less blend stages depending on the desired number of processed layers. Each layer (starting with layer 1) may specify where its source comes from to ensure that any source may be programmatically selected to be on any layer. As mentioned above, as shown, blend unit 310 has three sources (UI 304, UI 322, and video pipe 328) to be selected onto three layers (using blend stages 314-318). A CRC (cyclic redundancy check) may also be performed on the output of blend unit 310. Blend unit 310 may also be put into a CRC only mode, where only a CRC is performed on the output pixels without the output pixels being sent to the display controller.

As mentioned above, each source (UI 304 and 322, and video pipe 328) may provide a per pixel Alpha value. The Alpha values may be used to perform per-pixel blending, may be overridden with a static per-frame Alpha value (e.g. saturated Alpha), or may be combined with a static per-frame Alpha value (e.g. Dissolve Alpha). There may also be an option to have the per-pixel Alpha value pre-multiplied with the color component. In one set of embodiments, Alpha values may be represented as 8-bit indices that represent a value V, in the range $0<=V<=1.0$, where V=Alpha/255. In other words, the Alpha value may in fact represent a value in the range of 0 to 1 through an 8-bit value that is eventually normalized through division. More generally, the Alpha values may be represented as N-bit indices that correspond to V (as indicated above), the N-bit indices eventually normalized by being divided by $2^N-1$, yielding a value $V=Alpha/2^N-1$. Any pixel locations outside of a source's valid region may not be used in the blending. The layer underneath it may show through as if that pixel location had an Alpha value of zero. An Alpha of zero for a given pixel may indicate that the given pixel is invisible, and will not be displayed.

FIG. 4 shows a table 400 with different possible blend equations corresponding to different possible blending modes, according to one embodiment. In a 'Normal' mode, per-pixel Alpha values are combined with a dissolve Alpha value. In a 'Premultiplied' mode, per-pixel premultiplied Alpha values are combined with a dissolve Alpha value. In a 'Saturate' mode, the per-pixel Alpha values are overridden by a static per-frame Alpha value, or saturated Alpha value. As expressed in table 400, 'C[k,i]' represents the color component from layer [k] at pixel position [i], 'A[k,i]' represents the Alpha component from layer [k] at pixel position [i] (i.e. the per pixel Alpha value), 'ASat[k]' represents the static saturate Alpha value for layer [k] (i.e. the overriding static per-frame Alpha value), and 'ADis[k]' represents the static Dissolve Alpha value for layer [k] (i.e. the combining static per-frame Alpha value). Since the same per-pixel Alpha values may be used for each color component of a given pixel, an effective Alpha value (AEffCur[i]) for the current layer (k), and an effective Alpha value (AEffPrev[i]) for the layer underneath (k−1) may be calculated per pixel, and blended with each color component for the given pixel. Calculation of these effective Alpha values is tabulated in table 500 in FIG. 5.

These effective Alpha values may then be used in the blend calculations for each color component for a given pixel, expressed by the blend equation:

$$Cout[k,i]=AEffCur[i]*C[k,i]+(1-AEffPrev[i])*Cout[k-1,i], \quad (1)$$

where Cout[k,i] is the output value for layer 'k' at pixel position 'i', C[k,i] is the input value for layer 'k' at pixel position 'i', and Cout[k−1,i] is the output value for the previous layer 'k−1' at pixel position 'i'. It should be noted that in premultiplied mode, the current per-pixel Alpha value may be different from the previous per-pixel Alpha value, leading to the result overflowing, with all values in the result clamped to a value of '1'.

As previously noted, blend unit 310 in display pipe 300 may include multiple blend stages, (or blending stages) as exemplified by blend stages 314-318, which may blend multiple image layers into a single image layer. According to blend equation (1) as defined in tables 400 and 500, the output of each blend stage may be a fully blended color value for each color component of the given color space corresponding to a given layer. These color values may then be blended with the color values and Alpha value corresponding to the next layer, in a subsequent blend stage. In the embodiment shown in FIG. 3, at least four layers may be blended. A background layer (BG inside blend unit 310), a first image layer (from UI 304), a second image layer (from UI 322), and a video frame image layer (from video pipe 328). The color values (which may include a separate respective value in each color plane/component for a given pixel, e.g. an 'R' color plane value, a 'G' color plane value, and a 'B' color plane value) and Alpha values may all be in the range of '0' to '1', expressed as corresponding multi-bit values during processing, e.g. as 10-bit values for each color plane component, and 8-bit values for the Alpha. It should be noted, that the number of bits used for the Alpha value and the color values, respectively, may vary depending on various processing considerations. For example, as will be further discussed below, under certain circumstances, the number of color bits in a given first color space may be extended to include additional values that may not be valid in the given first color space, when converting from a second color space to the first color space, thereby adding to the number of bits used for representing the color values in the given first color space (e.g. when converting from the YCbCr color space to the RGB color space).

When performing blend operations using multi-bit data values, if the blend operation involves the multiplication of two N-bit numbers, the operation may yield a 2N-bit number. In order to return to the originally specified number of bits (i.e. N bits), this number is typically normalized by dividing the result by a number equal to '$2^N-1$'. Blend equation (1) may be implemented as a multi-step blend process, according to which each blend stage (314-318) may include multiple blend levels, as shown above. This means that each multiplication (by an Alpha value) also anticipates a corresponding normalization of the result. A straightforward way of implementing blend equation (1) according to tables 400 and 500 may yield one calculation for the effective Alpha value, and a specified number of additional calculations, each calculation performed to blend the effective Alpha value with color values of the previous layer and color values of the current layer per color component. Thus, for example, when operating in the RGB color space, there are three additional calculations, one for the 'R' color component, one for the 'G' color component, and one for the 'B' color component. These calculations may be represented by the following equations (shown for Normal mode, 8-bit Alpha values, and 10-bit color values for the purposes of illustration—other modes may be similarly derived based on tables 400 and 500 and the appropriate number of bits used for Alpha values and color values, as specified) per each blend stage:

$$AE[7:0]=(AD[7:0]*AP[7:0])/'d255, \quad (2)$$

where AE is the effective Alpha value (which has the same value for current layer and previous layer in Normal mode, as indicated in table 500), AD is the dissolve value (combined per-frame static Alpha value), and AP is the per-pixel Alpha value, $$CO[9:0]=((CCL[9:0]*AE[7:0])/'d255)+((CPL[9:0]*('d255-AE[7:0])/'d255), \quad (3)$$

where CO is the resultant color value of the given pixel for the given color component at the blend stage output, CCL is the color value of the given pixel for the given color component for the current layer, and CPL is the color value of the given pixel for the given color component for the previous layer. As previously mentioned, the previous layer represents the result from a previous blend stage, and the current layer is the layer to be blended with the results of the previous blend stage.

As observed in the above equations, normalization may be performed in three separate instances, once for each term that includes a multiplication by the Alpha component. The normalization division, however, may introduce errors, because the divide operation may be restricted to a fixed point, resulting in fractional portions being dropped. These dropped fractional portions may add up over all these levels (i.e. when performed for each term), resulting in ever-greater inaccuracies carried through each blend stage. However, color value normalizations are not required when the desired result is an actual color value, only at the end of a blend operation, where it may be necessary to normalize for the accumulated Alpha multiplications. In other words, equation (1) may be implemented in such a way as to delay the normalization, in effect reducing the actual number of divisions, thereby reducing the total number of fractional portions being dropped. Thus, normalization for the Alpha-value multiplications may not be performed at each blend level, carrying the results forward in fractional form instead, until the blending process is complete. Due to the exponential nature of the increase in the number of bits when carrying the results in fractional form, the extent to which intermediate results may be carried in fractional form may be determined by practical design and implementation considerations. In one set of embodiments, blend stages 314-318 may each perform a single division at the output of the blend stage, preventing the compounding of errors that may be incurred at each blend level within each given blend stage, if a division at each blend level were performed.

Thus, with respect to the blend operation, instead of performing the divide operation at the various levels within a blend stage, the denominator in equations (2) and (3) may be maintained (normalization not performed), and the denominators may be combined, performing the divide operation at the end, that is, at least at the output of a given blend stage. For example, a more accurate implementation of equation (1) may combine equations (2) and (3) into the following equation, which may apply to each color component within the given color space (using the same parameters that were used for equations (2) and (3)):

$$CO[9:0]=(CCL[9:0]*AD[7:0]*AP[7:0]+CPL[9:0]*('d65025-AD*AP))/'d65025. \quad (4)$$

It should be noted that 'd65025 is d'255 squared. As seen in equation (4), instead of calculating and normalizing the effective Alpha value, the blend operation is flattened out, and instead of the three divisions that were performed as per equations (2) and (3), only a single division is performed. While mathematically the combination of equations (2) and (3) is identical to equation (4), because each divide may introduce up to ½ a least significant bit of error, equation (4) may represent a significantly more accurate implementation of equation (1).

Figure 6A:
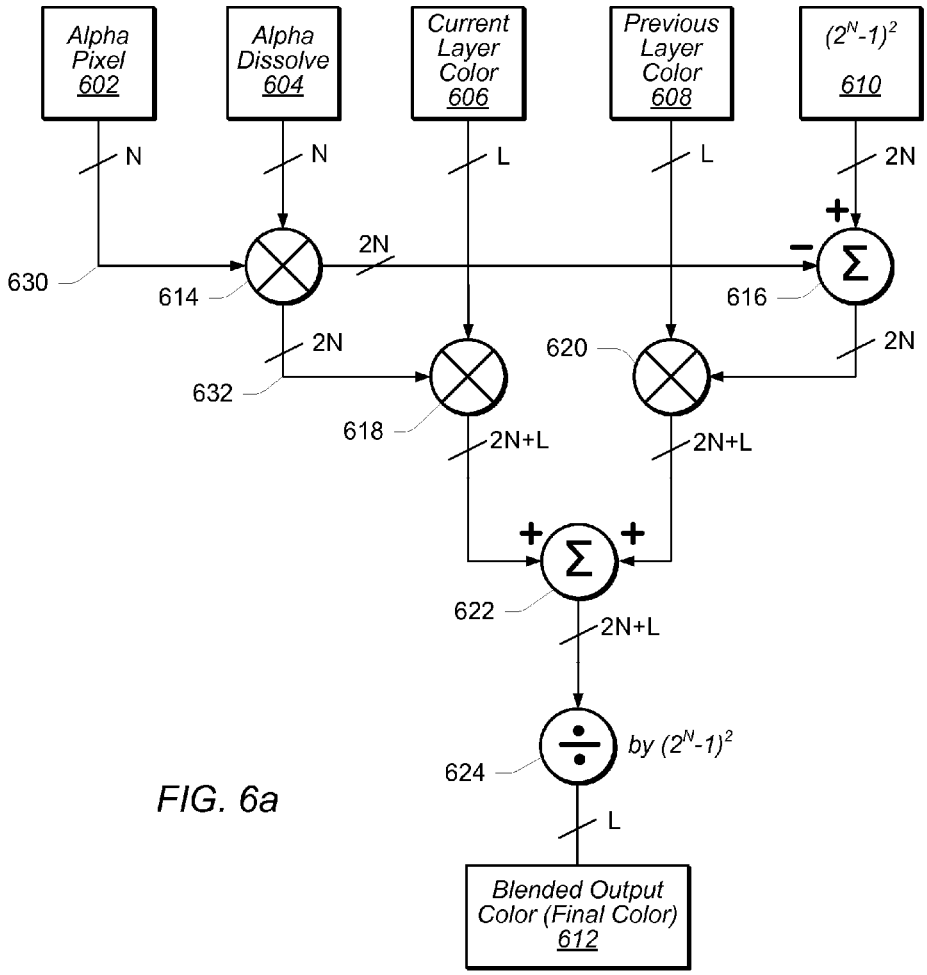
FIG. 6*a* shows the schematic diagram of a blend stage for blending frame pixels of two image layers, according to one embodiment.
Figure 6B:
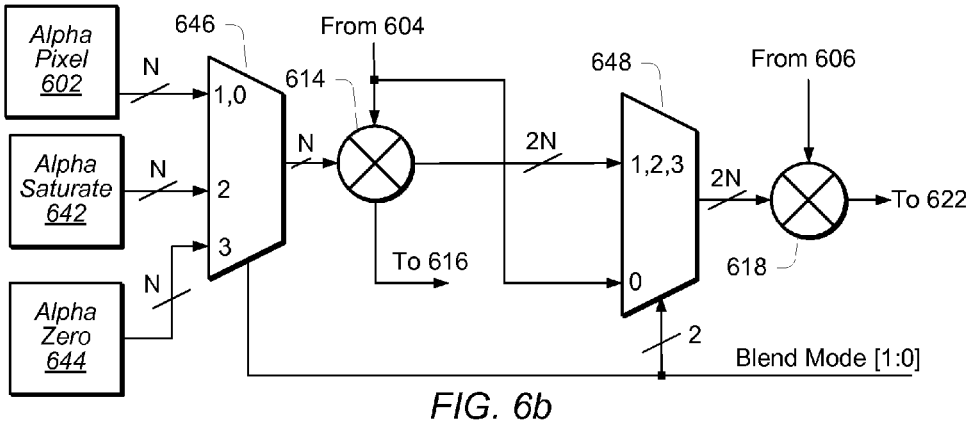
FIG. 6*b* shows the logic diagram of a selection mechanism for programming the blend stage of FIG. 6*a* to blend according one of different possible blend modes, according to one embodiment.

FIG. 6*a* shows the schematic diagram of one possible embodiment of a blend stage, (e.g. any of blend stages 314-318) for blending frame pixels of two image layers. The schematic in FIG. 6 shows the schematic for Normal blending mode implemented according to equation (4). It should be noted that the schematic of FIG. 6*a* may be modified to include other blending modes (e.g. Premultiplied mode, Saturate mode, and Disabled mode) based on the equations shown in table 400. This may be accomplished in a variety of different ways. For example, an enable signal may be used to output blended output color 612 (in Normal mode, Premultipled mode and Saturate mode), or previous layer color 608 (in Disabled mode). For purely illustrative purposes, FIG. 6*b* shows the schematic diagram of one possible selection block that may be incorporated into the blend stage shown in FIG. 6*a*, as will be further explained later. As seen in FIG. 6*a*, per-pixel Alpha value 602 may be multiplied with per-frame Alpha dissolve value 604 (at 614), and the 2N-bit wide result may be multiplied by the current layer color value 606 (at 618), and also subtracted from a value of $(2^N-1)^2$ 610, which is a 2N-bit wide representation of the normalized value '1' (at 616), then multiplied by the previous layer color value 608 (at 620). In one sense, the input 632 to multiplication element 618 may be considered the effective Alpha value for the current layer (k), and the output of summation element 616 into multiplication element 320 may be considered the effective Alpha value for the previous layer (k−1). Note that the use of the term "effective Alpha value" in this context differs from its use in Tables 400 and 500. For ease of understanding, the effective Alpha value corresponding to previous layer color 608 may be designated as the value (derived from the Alpha values) with which previous layer color 608 is multiplied. The results of multiplications 618 and 620 may then be summed (at 622), and the resulting sum may be divided by $(2^N-1)^2$ 610 (at 624), thereby producing a normalized, L-bit wide blended output color value 612. As indicated by the number of bits on each line, the results of the individual multiplications are carried without being normalized, resulting in a color value having a bit-length of 2N+L at the output of summation element 622.

As mentioned above, FIG. 6*b* shows the schematic diagram of one possible selection block that may be incorporated into the blend stage shown in FIG. 6*a*. More specifically, path 630 from the output of Alpha Pixel 602 to multiplication element 614 may be replaced by the output of selection element 646, and path 632 from multiplication element 614 to multiplication element 618 may be replaced by the output of selection element 648. A Blend Mode signal (which may be a 2-bit signal, as two bits are sufficient to express all four different blend modes) may be used to select between the different inputs to selection element 646. In the example shown, the (decimal) value of '0' corresponds to Premultipled mode, the value of '1' corresponds to Normal mode, the value of '2' corresponds to Saturate mode, and the value of '3' corresponds to Disabled mode. For example, in Premultiplied mode, Alpha Pixel value 602 is selected by the Blend Mode signal as the input of selection element 646, which consequently outputs Alpha Pixel value 602 to multiplication element 614. The Blend Mode signal also selects the Alpha Dissolve value 604 as the input of selection element 648, which consequently outputs Alpha Dissolve value 604 to multiplication element 618. For all other blend modes, the Blend Mode signal may select the output of multiplication element 614 as the input of selection element 648 to output to multiplication element 618. For Normal Mode, Alpha Pixel value 602 is provided to multiplication element 614 (just as in FIG. 6*a*), in Saturate Mode, Alpha Saturate value 642 is provided to multiplication element 614, and finally, in Disabled mode, a zero Alpha value 644 is provided to multiplication element 614. As mentioned above, FIG. 6*b* merely represents one possible embodiment of multiple blend modes being supported when using the implementation of a single blend stage exemplified in FIG. 6*a*.

Theoretically, if M layers are combined (M=4 in the embodiment shown in FIG. 3), and normalization is performed for multiplications by Alpha values (that are represented as N-bit indices), the division may be performed at the output of a last blend stage (e.g. blend stage 318 for the embodiment shown in FIG. 3) in the form of a division by $(2^N-1)^P$, where $P=2^{[M-1]}$. For example, when carrying the results through two blend stages (i.e. 3 layers), P equals $2^2$ (i.e. 4), and the denominator equals $(2^N-1)^4$. For 8-bit Alpha values, the value of this denominator is $255^4$, i.e. 4, 228, 250, 625. As is evident, the bit-size of the denominator may increase exponentially, and it may or may not be efficient to carry the results through multiple blend stages within certain designs. However, a significant reduction in the error introduced by the divisions may still be achieved by implementing equation (1) according to the schematic of FIG. 6*a* for each blend stage. In such embodiments, the division may be performed at the end of each stage by division element 624, leading to the output of each blend stage providing an L-bit wide output as the Previous Layer color value (608) to a next blend stage, until the final blend stage, which may produce the final color output.

When carrying the results through the final blend stage, the input of each subsequent blend stage may be a non-normalized color value. For example, if normalization is not performed at the end of blend stage 314, blend stage 314 may output a color value of bit-length of (2N+L), where 'L' is the specified, expected bit-size of the color value, to blend stage 316. In reference to FIG. 6*a*, this value is represented by the output of summation element 622. Thus, in blend stage 316, the Previous Layer Color input (corresponding to input 608 in FIG. 6*a*) into the corresponding multiplication element 620 may provide (2N+L) number of bits, instead of the L bits shown in FIG. 6*a*. Overall, when carrying the blend result in fractional from through each blend stage, the respective Previous Layer Color input of each subsequent blend stage will have the same number of bits as the output produced by the previous blend stage. Without normalization at the output of a given blend stage through multiple stages of blending until the final blend stage (e.g. until blend stage 318 in FIG. 3), the non-normalized output of each given blend stage, (except the final blend stage, which may have a normalized output) may be expressed by the following equation, when blending a total of 'M' layers, in Normal mode, with N-bit wide Alpha values, and L-bit wide color values:

$$CO[L-1:0]=CCL[L-1:0]*AD[N-1:0]*AP[N-1:0]*(2^N-1)^2+CPL[X:0]*((2^N-1)^2-AD[N-1:0]*AP[N-1:0]), \quad (5)$$

where X=2N+(M−1)*L. Normalization may then be performed at the end of the final blend stage, which may produce a final color output expressed by the following equation, when blending a total of 'M' layers, each blend stage blending two sets of pixel data respectively corresponding to two layers, one of those sets of pixels received from the output of a previous blend stage:

$$CO[L-1:0]=(CCL[L-1:0]*AD[N-1:0]*AP[N-1:0]*(2^N-1)^2+CPL[X:0]*((2^N-1)^2-AD[N-1:0]*AP[N-1:0]))/(2^N-1)^P, \quad (6)$$

where, as previously noted, $P=2^{[M-1]}$.

In one set of embodiments, valid source regions, referred to as active regions may be defined as the area within a frame that contains valid pixel data. Pixel data for an active region may be fetched from memory by UI 304 and 322, and stored within FIFOs 308 and 326, respectively. An active region may be specified by starting and ending (X,Y) offsets from an upper left corner (0,0) of the entire frame. The starting offsets may define the upper left corner of the active region, and the ending offsets may define the pixel location after the lower right corner of the active region. Any pixel at a location with coordinates greater than or equal to the starting offset and less than the ending offset may be considered to be in the valid region. Any number of active regions may be specified. For example, in one set of embodiments there may be up to four active regions defined within each frame and may be specified by region enable bits. The starting and ending offsets may be aligned to any pixel location. An entire frame containing the active regions may be sent to blend unit 310. Any pixels in the frame, but not in any active region would not be displayed, and may therefore not participate in the blending operation, as if the pixels outside of the active had an Alpha value of zero. In alternate embodiments, blend unit 310 may be designed to receive pixel data for only the active regions of the frame instead of receiving the entire frame, and automatically treat the areas within the frame for which it did not receive pixels as if it had received pixels having a blending value (Alpha value) of zero.

In one set of embodiments, one active region may be defined within UI 304 (in registers 319*a*-319*n*) and/or within UI 322 (in registers 321*a*-321*n*), and may be relocated within the display destination frame. Similar to how active regions within a frame may be defined, the frame may be defined by the pixel and addressing formats, but only one active region may be specified. This active region may be relocated within the destination frame by providing an X and Y pixel offset within that frame. The one active region and the destination position may be aligned to any pixel location. It should be noted that other embodiments may equally include a combination of multiple active regions being specified by storing information defining the multiple active regions in registers 319*a*-319*n* and in registers 321*a*-321*n*, and designating one or more of these active regions as active regions that may be relocated within the destination frame as described above.

In one set of embodiments, the active regions in a frame may represent graphics overlay to appear on top of another image or a video stream. For example, the active regions may represent a static image superimposed atop a video stream. In some embodiments, active regions may more generally represent an overlay window that may be used to superimpose any desired information atop information presented in the background layer underneath. For example, display pipe 212 may include more than one video pipe similar to video pipe 220 (or 328, as shown in FIG. 3), and overlay video information in the active region. Similarly, instead of a video stream, static images may be displayed underneath the active regions, and so forth. Referring again to FIG. 3, video pipe 328 may provide a video stream to blend unit 310, while UI 304 and 322 may provide image frames with pixels in the active region representing a static image overlay to be displayed atop the video stream. In this case, the output frames provided from FIFO 320 to the display controller may include video pixel information from video pipe 328, with the fetched pixels from FIFO 308 (which may first be scaled by vertical scaling block 307 and horizontal scaling block 309) and/or FIFO 326 (which may first be scaled by vertical scaling block 327 and horizontal scaling block 329) superimposed on top of the video pixel information, blended together by blend unit 310 according to the Alpha values and other pertinent characteristics of the fetched pixels, as described above with reference to blend unit 310. Again, different embodiments may include various combinations of video and static image information blended and displayed in a similar manner, with the functionality of the display pipe expanded accordingly with additional video pipes and/or user interfaces as needed. Blend unit 310 may similarly be expanded to accommodate the additional pixels that may need to be blended.

In one set of embodiments, using fetch unit 330, video pipe 328 may fetch video frame data/information from memory through host master interface 302. The video frame data/information may be represented in a given color space, for example YCbCr color space. Video pipe 328 may insert random noise (dither) into the samples (dither unit 332), and scale that data in both vertical and horizontal directions (scalers 336 and 338) after buffering the data (buffers 334). In some embodiments, blend unit 310 may expect video (pixel) data to be represented in a different color space than the original color space (which, as indicated above, may be the YCbCr color space). In other words, blend unit 310 may operate in a second color space, e.g. in the RGB color space. Therefore, the video frame data may be converted from the first color space, in this case the YCbCr color space, to the second color space, in this case the RGB color space, by color space converter unit 340. It should be noted that while color space converter unit 340 is shown situated within video pipe 328, it may be situated anywhere between the output provided by video pipe 328 and the input provided to blend unit 310, as long as the data that is ready to be provided to blend unit 310 has been converted from the first color space to the second color space prior to the data being processed and/or operated upon by blend unit 310.

The converted data (that is, data that is represented in the second color space, in this case in the RGB color space) may then be buffered (FIFO 342), before being provided to blend unit 310 to be blended with other planes represented in the second color space, as previously discussed. During the process of converting data represented in the first color space into data represented in the second color space, there may be some colors represented in the first (i.e. the YCbCr) color space that cannot be represented in the second (i.e. RGB) color space. For example, the conversion may yield an R, G, or B component value of greater than 1 or less than 0. Displaying videos on certain display devices may therefore yield different visual results than desired and/or expected. Therefore, in at least one set of embodiments, blend unit 310 may be designed to perform blending operations using the converted pixel values even when the converted pixel values do not represent valid pixel values in the second color space. For example, if the second color space (or the operating color space of blend unit 310) is the RGB color space, blend unit 310 may allow RGB values as high as +4 and as low as −4. Of course these values may be different, and may also depend on what the original color space is. While these values may not represent valid pixel values in the second (i.e. RGB) color space, they can be converted back to the correct values in the first (i.e. the YCbCr) color space. Accordingly, the color information from the original (YCbCr) color space may be maintained through video pipe 328, and may be displayed properly on all display devices that display the video frames. It should therefore also be noted that the bitwise length (noted as 'L' in FIG. 6*a*, and the corresponding description above) of the color values used in blend unit 310 may differ from what may be expected for the given color space in which blend unit 310 may operate. However, the various embodiments described herein will operate with Alpha values and color values having any specified bit-size, or, in other words, having a width of any specified number of bits.

Thus, before displaying the blended pixels output by final blend stage 318, the blended pixels may be converted from the second color space (i.e. RGB in this case) to the original video color space (i.e. the YCbCr color space in this case) through color space conversion unit 341. As was the case with video pipe 328, while color space conversion unit 341 is shown situated within blend unit 310 and between blend stage 318 and FIFO 320, in alternate embodiments the color space conversion may be performed on the display controller side, prior to being provided to the display, and various other embodiments are not meant to be limited by the embodiment shown in FIG. 3.

In one set of embodiments, a parameter FIFO 352 may be used to store programming information for registers 319*a*-319*n*, 321*a*-321*n*, 317*a*-317*n*, and 323*a*-323*n*. Parameter FIFO 352 may be filled with this programming information by control logic 344, which may obtain the programming information from memory through host master interface 302. In some embodiments, parameter FIFO 352 may also be filled with the programming information through an advanced high-performance bus (AHB) via host slave interface 303.

Figure 7:
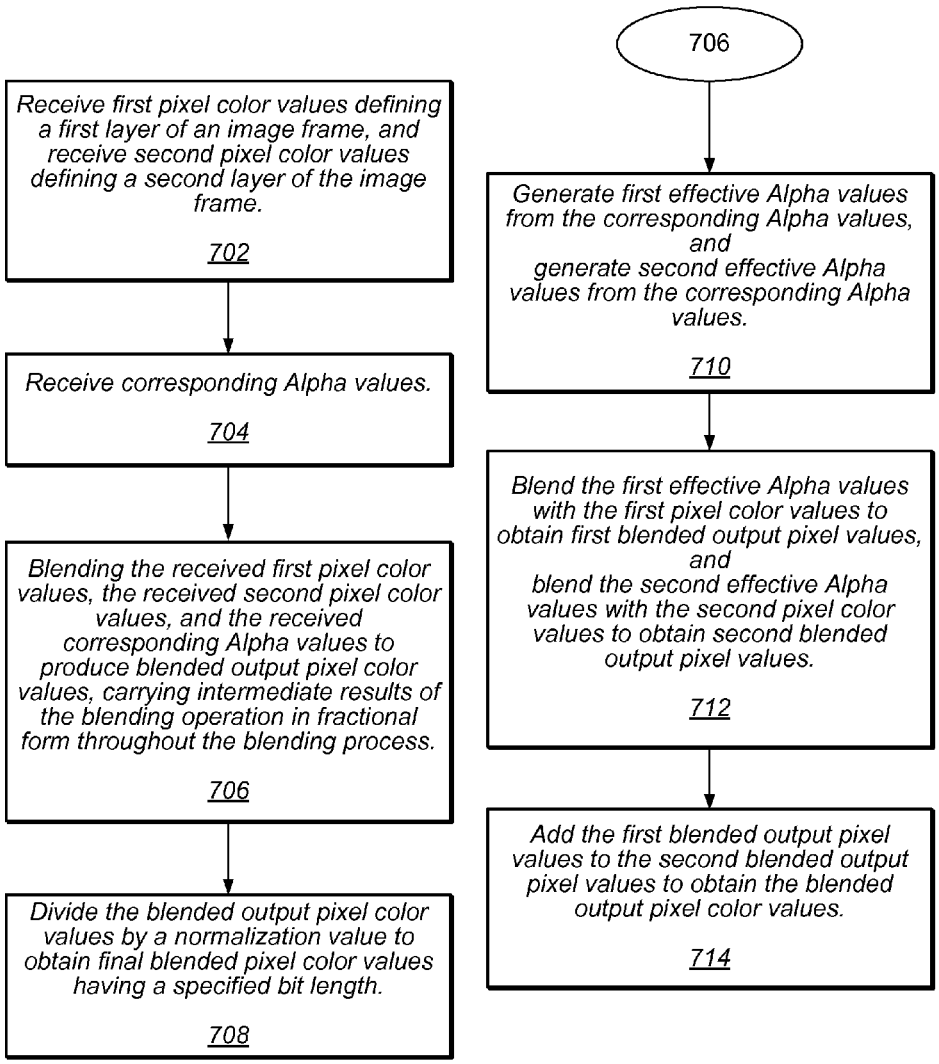
FIG. 7 is a flow chart illustrating one embodiment of a method for blending pixels.

Turning now to FIG. 7, a flowchart is shown illustrating one embodiment of a method for blending pixels. As indicated in 702, first pixel color values defining a first layer of an image frame, and second pixel color values defining a second layer of the image frame may be received (704), for example by a blend stage (such as blend stage 314 shown in FIG. 3. Corresponding Alpha values may also be received by the same blend stage along with the color pixel values. The received first pixel color values, the received second pixel color values, and the received corresponding Alpha values may then be blended to produce blended output pixel color values, carrying intermediate results of the blending operation in fractional form throughout the blending process (706). The blended output pixel color values may be divided by a normalization value to obtain final blended pixel color values having a specified bit length (708). The specified bit-length may be the bit-length of each pixel color value, and may be specified based on the color space and representation of pixel color values in that color space.

In one set of embodiments, the blending process in 706 may include generating first effective Alpha values from the corresponding Alpha values, and second effective Alpha values from the corresponding Alpha values (710), and blending the first effective Alpha values with the first pixel color values to obtain first blended output pixel values, and blending the second effective Alpha values with the second pixel color values to obtain second blended output pixel values (712). Subsequently, The first blended output pixel values may be added to the second blended output pixel values to obtain the blended output pixel color values (714). The first effective Alpha values may be generated by multiplying two of the corresponding Alpha values together (e.g. for a given first pixel color value, the per-pixel Alpha value corresponding to the given first pixel color value may be multiplied by a dissolve Alpha value), and the second effective Alpha values may be generated by subtracting the first effective Alpha values from a specified value corresponding to a maximum Alpha value. In some embodiments, the maximum Alpha value may be '1', represented as 8-bit indices (binary numbers). The normalization value may therefore correspond to a final denominator of the fractional form in which the intermediate results of the blending are carried until the blending is complete, and may be determined by how many multiplications are performed throughout the blending process.

Figure 8:
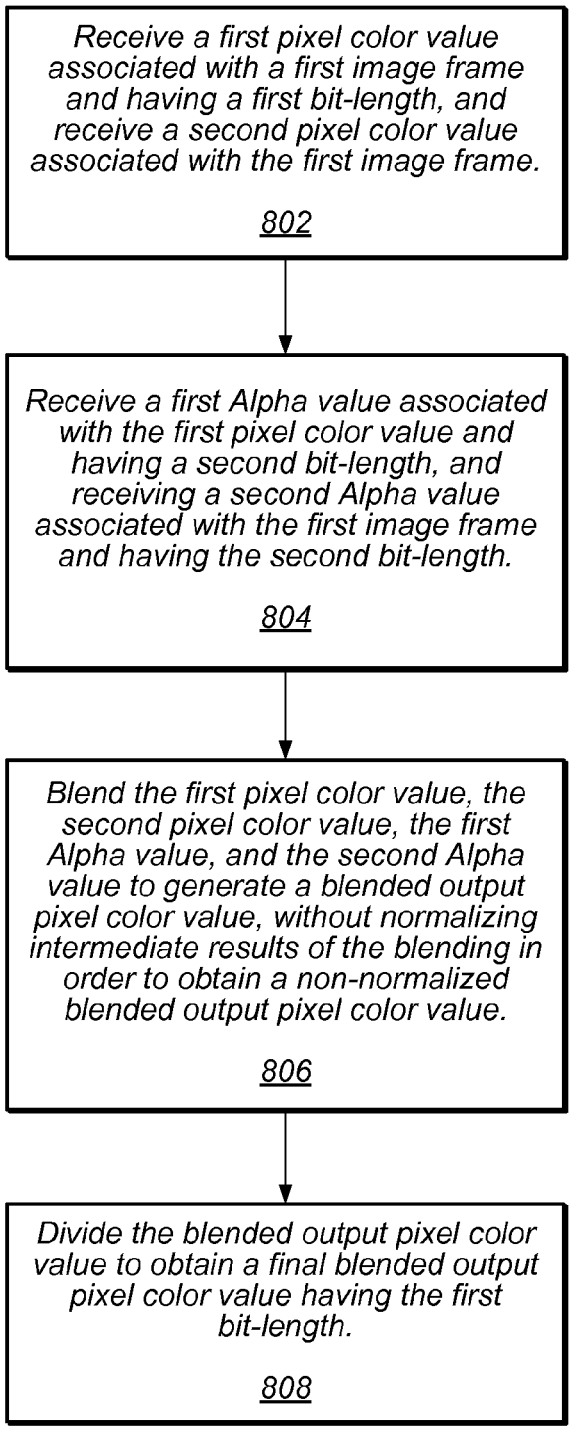
FIG. 8 is a flow chart illustrating another embodiment of a method for blending pixels.

Turning now to FIG. 8, a flowchart is shown illustrating another possible embodiment of a method for blending pixels. A first pixel color value associated with a first image frame and having a first bit-length (e.g. 10 bits), and a second pixel color value associated with the first image frame may both be received (802), e.g. by a blend unit, such as blend unit 310 shown in FIG. 3. The blend unit may also receive a first Alpha value associated with the first pixel color value and having a second bit-length (e.g. 8 bits), and a second Alpha value associated with the first image frame and having the same bit-length as the first Alpha value (804). The blend unit may then blend the first pixel color value, the second pixel color value, the first Alpha value, and the second Alpha value to generate a blended output pixel color value, without normalizing intermediate results of the blending in order to obtain a non-normalized blended output pixel color value (806). Finally, the blend unit may divide the blended output pixel color value to obtain a final blended output pixel color value having the same bit-length (e.g. 10 bits) as the first pixel color value (808), which may also be representative of the bit-length of the pixel color values for the given color space with which the pixels are associated, and in which the blending process is performed.

In one set of embodiments, 802-806 may be performed by a blend stage configured within the blend unit (e.g. blend stages 316-318 shown in FIG. 3), configured to blend two layers of an image frame. In such a case, a previous blend stage (e.g. blend stage 314) may provide the second pixel color value to the blend stage. The previous blend stage may receive a third pixel color value of the same bit-length as the first pixel color value, and associated with the first image frame, and may also receive a fourth pixel color value associated with the first image frame. The previous blend stage may also receive a third Alpha value associated with the third pixel color value and having the same bit-length as the other Alpha values, and may also receive a fourth Alpha value associated with the fourth image frame and having the same bit-length as the other Alpha values. The previous blend stage may blend the third pixel color value, the fourth pixel color value, the third Alpha value, and the fourth Alpha value to generate a second blended output pixel color value, without normalizing intermediate results of the blending to obtain a non normalized second blended output pixel color value. In one set of embodiments, the previous blend stage may provide the non-normalized second blended output pixel color value to the blend stage as the second pixel color value. In another set of embodiments, the previous blend stage may divide the second blended output pixel color value to obtain a second final blended output pixel color value having the same bit-length as the third pixel color value, and may provide the second final blended output pixel color value to the blend stage as the second pixel color value. The first pixel color value may be associated with a first layer of the first image frame and the second pixel color value may be associated with a second layer of the first image frame.

Numerous variations and modifications will become apparent to those skilled in the art once the above disclosure is fully appreciated. It is intended that the following claims be interpreted to embrace all such variations and modifications.

We claim:

1. A blend stage comprising:

a first input configured to receive first pixel color values corresponding to a first layer of an image frame;

a second input configured to receive second pixel color values corresponding to a second layer of the image frame;

a set of inputs configured to receive Alpha values corresponding to the received first pixel values and received second pixel values;

a blending block configured to perform a blend operation on the received first pixel values, the received second pixel values, and the received Alpha values, wherein the blend unit is further configured to carry multiplication results in fractional form as numerator and denominator throughout the blend operation for two or more multiplications performed during the blend operation, and produce a blended color value;

a divide unit configured to divide the blended color value by a normalization value corresponding to the received Alpha values, to produce a final blended color value;

wherein the blending block comprises one or more of:

logic circuitry configured to perform part of or all of the blend operation; or a processing unit coupled to a non-transitory memory unit configured to store instructions executable by the processing unit to perform part of or all of the blend operation.

2. The blend stage of claim 1, wherein the received Alpha values comprise one or more of:

a respective per pixel Alpha value associated with each first pixel color value;

a per frame dissolve Alpha value associated with the image frame; and a per frame static Alpha value associated with the image frame.

3. The blend stage of claim 2, wherein the blending block is programmable to perform the blend operation according to one of a plurality of available blend modes, wherein the blending block is configured to blend a different combination of the received Alpha values with the received first pixel values and the received second pixel values in each blend mode.

4. The blend stage of claim 3, wherein the plurality of blend modes comprise one or more of:

a normal blend mode, in which the blending block is configured to:

multiply the received respective per pixel Alpha values with the received per frame dissolve Alpha value to produce first effective Alpha values; and blend the first effective Alpha values with the received first pixel color values and the received second pixel color values;

a premultiplied blend mode, in which the blending block is configured to:

multiply the received respective per pixel Alpha values with the received per frame dissolve Alpha value to produce second effective Alpha values;

blend the second effective Alpha values with the received second pixel color values; and blend the received per frame dissolve Alpha value with the received first pixel color values; and a saturate mode, in which the blending block is configured to:

multiply the received per frame static Alpha value with the received per frame dissolve Alpha value to produce a third effective Alpha value; and blend the third effective Alpha value with the received first pixel color values and the received second pixel color values.

5. The blend stage of claim 1, wherein the first layer of the image frame is a current layer and the second layer of the image frame is a previously blended layer.

6. A blend unit comprising:

a plurality of blend stages configured to perform blending operations, wherein each blend stage is configured to blend pixel color values and their corresponding Alpha values to produce blended output pixel color values as part of the blending operations, wherein the plurality of blend stages comprise one or more of:

logic circuitry configured to perform part of or all of the blending operations; or a processing unit coupled to a non-transitory memory unit configured to store instructions executable by the processing unit to perform part of or all of the blending operations;

wherein a first blend stage of the plurality of blend stages is configured to receive two pixel color values and their corresponding Alpha values, and blend the two pixel color values and their corresponding Alpha values;

wherein each remaining blend stage of the plurality of blend stages is configured to receive a blended output pixel color value from another one of the plurality of blend stages, a pixel color value, and their corresponding Alpha values, and blend the blended output pixel color value, the pixel color value, and their corresponding Alpha values; and wherein the plurality of blend stages are configured to perform all blend operations without normalization; and a divide unit coupled to receive a blended output pixel value of a final blend stage of the plurality of blend stages, and configured to divide the received blended output pixel color value of the last blend stage by a normalization value to generate a final pixel color value having a specified bit-length.

7. The blend unit of claim 6, wherein each of the two pixel color values received by the first blend stage has the specified bit-length.

8. The blend unit of claim 6, wherein the corresponding Alpha values comprise per pixel Alpha values associated with the pixel color values, a dissolve Alpha value associated with an image frame defined by the pixel color values, and a static Alpha value associated with the image frame defined by the pixel color values.

9. The blend unit of claim 8, wherein in blending the pixel color values and their corresponding Alpha values to produce the blended output pixel color values, each blend stage is configured to:

generate corresponding effective Alpha values from the per pixel Alpha values, the dissolve Alpha value, and the static Alpha value; and multiply the corresponding effective Alpha values with the pixel color values.

10. The blend unit of claim 8, wherein the pixel color values comprise first pixel color values corresponding to a first layer and second pixel color values corresponding to a second layer, wherein each blend stage is configured to:

generate first effective Alpha values corresponding to the first pixel color values and second effective Alpha values corresponding to the second pixel color values from the per pixel Alpha values, the dissolve Alpha value, and the static Alpha value;

multiply the first effective Alpha values with the first pixel color values to obtain first blended pixel color values;

multiply the second effective Alpha values with the second pixel color values to obtain second blended pixel color values; and add the first blended pixel color values to the second blended pixel color values to obtain the blended output pixel color values.

11. A method for blending pixels, the method comprising:

receiving, by graphics processing hardware, first pixel color values defining a first layer of an image frame;

receiving, by the graphics processing hardware, second pixel color values defining a second layer of an image frame;

receiving, by the graphics processing hardware, corresponding Alpha values;

blending, by the graphics processing hardware, the received first pixel color values, the received second pixel color values, and the received corresponding Alpha values to produce blended output pixel color values, comprising carrying intermediate results of the blending in fractional form as numerator and denominator throughout the blending; and dividing, by the graphics processing hardware, the blended output pixel color values by a normalization value to obtain final blended pixel color values having a specified bit-length.

12. The method of claim 11, wherein the blending comprises:

generating first effective Alpha values from the corresponding Alpha values;

generating second effective Alpha values from the corresponding Alpha values;

blending the first effective Alpha values with the first pixel color values to obtain first blended output pixel values;

blending the second effective Alpha values with the second pixel color values to obtain second blended output pixel values; and adding the first blended output pixel values to the second blended output pixel values to obtain the blended output pixel color values.

13. The method of claim 12, wherein generating the first effective Alpha values comprises multiplying two of the corresponding Alpha values together; and wherein generating the second effective Alpha values comprises subtracting the first effective Alpha values from a specified value corresponding to a maximum Alpha value.

14. The method of claim 11, wherein the normalization value corresponds to a final denominator of the fractional form in which the intermediate results of the blending are carried until the blending is complete.

15. A method for blending pixels, the method comprising:

receiving, by graphics processing hardware, a first pixel color value associated with a first image frame and having a first bit-length;

receiving, by the graphics processing hardware, a second pixel color value associated with the first image frame;

receiving a first Alpha value associated with the first pixel color value and having a second bit-length;

receiving, by the graphics processing hardware, a second Alpha value associated with the first image frame and having the second bit-length;

blending, by the graphics processing hardware, the first pixel color value, the second pixel color value, the first Alpha value, and the second Alpha value to generate a blended output pixel color value, carrying intermediate results of the blending in form of a numerator and denominator to obtain a non-normalized blended output pixel color value; and dividing, by the graphics processing hardware, the blended output pixel color value to obtain a final blended output pixel color value having the first bit-length.

16. The method of claim 15, wherein all the receiving and the blending is performed by a blend stage configured to blend two layers of an image frame.

17. The method of claim 16, further comprising:

a previous blend stage receiving a third pixel color value having the first bit-length and associated with the first image frame;

the previous blend stage receiving a fourth pixel color value associated with the first image frame;

the previous blend stage receiving a third Alpha value associated with the third pixel color value and having the second bit-length;

the previous blend stage receiving a fourth Alpha value associated with the fourth image frame and having the second bit-length;

the previous blend stage blending the third pixel color value, the fourth pixel color value, the third Alpha value, and the fourth Alpha value to generate a second blended output pixel color value, without normalizing intermediate results of the blending to obtain a non-normalized second blended output pixel color value; and one of:

the previous blend stage providing the non-normalized second blended output pixel color value to the blend stage as the second pixel color value; and the previous blend stage dividing the second blended output pixel color value to obtain a second final blended output pixel color value having the first bit-length, and providing the second final blended output pixel color value to the blend stage as the second pixel color value.

18. The method of claim 15, wherein the first pixel color value is associated with a first layer of the first image frame and the second pixel color value is associated with a second layer of the first image frame.

19. A system comprising:

system memory configured to store:

first visual information comprising first pixels having respective first color values and corresponding respective first Alpha values; and second visual information comprising second pixels having respective second color values and corresponding respective second Alpha values; and a display pipe configured to:

fetch the first color values and the corresponding respective first Alpha values from the system memory;

fetch the second color values and the corresponding respective second Alpha values from the system memory;

for each first color value of the first color values, a corresponding respective first Alpha value of the corresponding respective first Alpha values, a corresponding second color value of the second color values, and a corresponding respective second Alpha value of the corresponding respective second Alpha values:

perform a blend operation on the first color value, the corresponding second color value, the corresponding respective first Alpha value, and the corresponding respective second Alpha value to produce a blended output color value, carrying intermediate results of the blend operation in fractional form as numerator and denominator throughout the blend operation to produce a non-normalized blended output color value; and divide the non-normalized blended output color value by a specified number to obtain a final blended output color value having a specified bit-length.

20. The system of claim 19, wherein the specified bit-length is a bit-length of each first color value of the first color values.

21. The system of claim 19, wherein the specified number is determined by a bit-length of the corresponding respective first Alpha value, and a bit-length of the corresponding respective second Alpha value.

22. The system of claim 19;

wherein the first visual information comprises one or more of:

static image information; or video image information; and wherein the second visual information comprises one or more of:

static image information; or video image information.

23. The system of claim 19, wherein the final blended output color value represents visual information comprising the first visual information overlaid atop the second visual information.

* * * * *